US011137196B2

(12) United States Patent
Lindel et al.

(10) Patent No.: US 11,137,196 B2
(45) Date of Patent: Oct. 5, 2021

(54) HOUSEHOLD REFRIGERATOR WITH SPECIFIC COVER SYSTEM IN A RECEIVING SPACE FOR FOOD

(71) Applicant: BSH HAUSGERAETE GMBH, Munich (DE)

(72) Inventors: Andreas Lindel, Heidenheim (DE); Thomas Schaefer, Giengen (DE); Marcus Wehlauch, Nattheim (DE)

(73) Assignee: BSH Hausgeraete GmbH, Munich (DE)

( * ) Notice: Subject to any disclaimer, the term of this patent is extended or adjusted under 35 U.S.C. 154(b) by 158 days.

(21) Appl. No.: 15/833,627

(22) Filed: Dec. 6, 2017

(65) Prior Publication Data

US 2018/0164021 A1 Jun. 14, 2018

(30) Foreign Application Priority Data

Dec. 9, 2016 (DE) ..... 10 2016 224 608.9

(51) Int. Cl.

| | |
|---|---|
| ***F25D 17/06*** | (2006.01) |
| ***F25D 23/00*** | (2006.01) |
| ***F25D 23/06*** | (2006.01) |
| ***F25D 11/00*** | (2006.01) |

(52) U.S. Cl.

CPC ..... *F25D 23/006* (2013.01); *F25D 11/00* (2013.01); *F25D 17/065* (2013.01); *F25D 23/06* (2013.01); *F25D 23/066* (2013.01); *F25D 17/067* (2013.01); *F25D 2317/067* (2013.01)

(58) Field of Classification Search

CPC ..... F25D 23/006; F25D 23/06; F25D 23/066; F25D 17/045; F25D 17/065; F25D 17/062

See application file for complete search history.

(56) References Cited

U.S. PATENT DOCUMENTS

| | | | | |
|---|---|---|---|---|
| 3,436,931 A * | 4/1969 | Gelbard | F25D 21/08 | 62/276 |
| 3,732,705 A * | 5/1973 | McCullough | F25D 17/062 | 62/275 |
| 4,509,335 A * | 4/1985 | Griffin | F25D 17/065 | 62/298 |
| 4,512,162 A * | 4/1985 | Etou | F25D 11/022 | 62/298 |
| 4,638,644 A * | 1/1987 | Gidseg | F25D 17/065 | 62/329 |

(Continued)

FOREIGN PATENT DOCUMENTS

| | | |
|---|---|---|
| CN | 101688729 A | 3/2010 |
| CN | 103673465 A | 3/2014 |

(Continued)

*Primary Examiner* — Kimberley S Wright

(74) *Attorney, Agent, or Firm* — Laurence A. Greenberg; Werner H. Stemer; Ralph E. Locher

(57) ABSTRACT

A household refrigerator has a receiving space for food which is delimited by walls of an inner container. A covering plate that is separate from the inner container is arranged in the receiving space in front of a wall of the inner container. A functional unit of the household refrigerator is arranged in the receiving space in front of the wall and in one spatial direction of the household refrigerator the covering plate ends next to the functional unit. The functional unit is covered, at least in certain sections, by a cover that is separate from the covering plate.

15 Claims, 5 Drawing Sheets

(56) References Cited

U.S. PATENT DOCUMENTS

| | | | | |
|---|---|---|---|---|
| 5,819,552 | A * | 10/1998 | Lee | F25D 17/065 62/407 |
| 7,762,100 | B2 * | 7/2010 | Bae | F25D 17/065 62/413 |
| 8,359,880 | B2 * | 1/2013 | Lee | F25D 17/065 62/419 |
| 8,806,885 | B2 * | 8/2014 | Bae | F25D 17/065 62/407 |
| 8,904,817 | B2 * | 12/2014 | Kim | F25D 17/065 62/419 |
| 9,086,234 | B2 * | 7/2015 | Gu | F25D 17/04 |
| 10,203,146 | B2 * | 2/2019 | Jung | F25D 25/025 |
| 10,254,038 | B2 * | 4/2019 | Jung | F25D 11/02 |
| 10,317,123 | B1 * | 6/2019 | Wohlers | F25D 11/022 |
| 10,345,036 | B2 * | 7/2019 | Hong | F25D 23/028 |
| 2008/0156029 | A1 * | 7/2008 | Ritchie | F25D 17/065 62/408 |
| 2009/0090121 | A1 * | 4/2009 | Hecht | F25D 23/006 62/298 |
| 2009/0113920 | A1 * | 5/2009 | Bae | F25D 17/065 62/440 |
| 2009/0113922 | A1 * | 5/2009 | Wiest | F25D 23/065 62/441 |
| 2009/0113924 | A1 * | 5/2009 | Bae | F25D 17/065 62/447 |
| 2010/0060116 | A1 * | 3/2010 | Okano | H05K 5/0204 312/223.1 |
| 2010/0064719 | A1 * | 3/2010 | Lee | F25D 17/065 62/419 |
| 2010/0125365 | A1 * | 5/2010 | Ahn | F25D 17/065 700/275 |
| 2012/0011879 | A1 * | 1/2012 | Gu | F25D 17/04 62/408 |
| 2012/0285193 | A1 * | 11/2012 | Choi | F25D 23/062 62/419 |
| 2013/0086936 | A1 * | 4/2013 | Choi | F25D 17/065 62/419 |
| 2016/0334159 | A1 * | 11/2016 | Hong | F25D 23/028 |
| 2017/0159991 | A1 * | 6/2017 | Cho | F25D 17/062 |
| 2017/0198961 | A1 * | 7/2017 | Jung | F25D 25/025 |
| 2018/0156528 | A1 * | 6/2018 | Lindel | F25D 23/006 |
| 2018/0164029 | A1 * | 6/2018 | Lindel | F25D 23/066 |
| 2018/0172331 | A1 * | 6/2018 | Tomohiko | F25D 29/003 |
| 2018/0340726 | A1 * | 11/2018 | Cha | F25D 17/065 |
| 2019/0107323 | A1 * | 4/2019 | Dai | F25D 23/006 |

FOREIGN PATENT DOCUMENTS

| | | | |
|---|---|---|---|
| CN | 204176999 | U | 2/2015 |
| CN | 106030225 | A | 10/2016 |
| DE | 102005032976 | A1 | 10/2006 |
| DE | 102010041952 | A1 | 4/2012 |
| DE | 102014100349 | A1 | 7/2015 |
| JP | S514369 | Y2 | 2/1976 |
| JP | 2000245592 | A | 9/2000 |

* cited by examiner

HOUSEHOLD REFRIGERATOR WITH SPECIFIC COVER SYSTEM IN A RECEIVING SPACE FOR FOOD

CROSS-REFERENCE TO RELATED APPLICATION

This application claims the benefit, under 35 U.S.C. § 119, of German patent application DE 10 2016 224 608.9, filed Dec. 9, 2016; the prior application is herewith incorporated by reference in its entirety.

BACKGROUND OF THE INVENTION

Field of the Invention

The invention relates to a household refrigerator having a receiving space for food, which is delimited by walls of an inner container. The household refrigerator has a covering plate that is separate from the inner container and that is arranged in the receiving space in front of a wall of the inner container.

Household refrigerators, in which, in addition to walls of an inner container, additional further panels are also present, are known from the prior art. It is therefore known that functional units of the household appliance, such as, for example a fan or an evaporator, are arranged behind a covering plate and are therefore positioned in a gap between a wall and a covering plate of this kind. This is known, for example, in no-frost-household refrigerators.

A no-frost household refrigerator of this kind is known, for example, from German published patent application DE 10 2010 041 952 A1. Formed in an upper region of the receiving space is a suction opening and in a lower region an outlet opening or a discharge opening. In the depth direction of the household refrigerator the two openings are essentially arranged at the same depth and are formed in a rear half of the receiving space. Owing to this arrangement of the openings, air circulation can possibly be circulated to only a limited extent over the entire receiving space, in particular only in a rear half of the receiving space since, as a result of the suction in the upper region, the air discharged at the bottom is possibly immediately sucked upwards again, so a corresponding section of the receiving space, in particular a region close to the door, is subject to this air circulation only under certain conditions.

A household refrigerator is known from published patent application US 2009/0090121 A1 and its counterpart German published patent application DE 10 2005 032 976 A1 in which in a receiving space for food an additional separate assembly plate is arranged in front of the back wall of the inner container and is fixed with screws.

Furthermore, household refrigerators of this kind having an additional covering plate in front of a back wall of an inner container are known from German published patent application DE 10 2014 100 349 A1.

The known cover plates are relatively large and extend over the entire height of a back wall of this inner container.

SUMMARY OF THE INVENTION

It is accordingly an object of the invention to provide a household refrigeration device which overcomes the above-mentioned and other disadvantages of the heretofore-known devices and methods of this general type and in which the assembly effort is reduced, and improved individuality can be achieved.

With the foregoing and other objects in view there is provided, in accordance with the invention, a household refrigerator, comprising:

an inner container formed with walls delimiting a receiving space for food;

a functional unit of the household refrigerator disposed in said receiving space in front of a given wall of said inner container;

a covering plate separate from said inner container and disposed in said receiving space in front of the given wall, said covering plate, in one spatial direction of the household refrigerator, ending next to said functional unit; and a cover separate from said covering plate, said cover covering said functional unit at least in certain sections thereof.

In other words, the household refrigerator according to the invention has at least one receiving space for food which is delimited by walls of an inner container of the household refrigerator. The household refrigerator has a covering plate separate from the inner container, and therefore from a wall of an inner container, which is arranged in the receiving space in front of a wall of the inner container and therefore is arranged at the receiving space side. A fundamental idea of the invention can be seen in that a functional unit of the household refrigerator is arranged in the receiving space in front of the wall. Viewed in at least one spatial direction, the covering plate ends next to the functional unit and the functional unit is covered at least in certain sections by a cover separate from the covering plate. Viewed in this at least one spatial direction, the covering plate is therefore arranged without overlapping the functional unit. In particular with a projected image view in a plane which is spanned by this spatial direction and a further spatial direction in addition, the functional unit and covering plate do not overlap.

The invention therefore creates a cover system in a household refrigerator which has a plurality of cover parts designed with a covering function. A design of this kind makes access easier to individual local sections in the receiving space, which are covered by a respective cover part of this kind, since then only the cover part with which this local region is covered has to be removed. The assembly effort is reduced thereby and the individuality of the respective installation of the cover parts can then be oriented quite specifically to the respective installation situation in the receiving space. A very needs-based cover system can also be provided which is individually adjusted in respect of local position and/or size and/or attachment points of the individual cover parts. A very compact cover system can also be created thereby which satisfies the respective needs also in respect of the covering function of specific functional units better.

The ends of the covering plate in a spatial direction next to the functional unit can, as a function of the local installation of the functional units, mean that, for example, the functional unit and the covering plate are arranged side by side in the width direction of the household refrigerator and, viewed in this width direction, the covering plate therefore does not overlap the functional unit. This can likewise additionally or alternatively also apply if the functional unit and the covering plate are arranged side by side in the height direction of the household refrigerator. The functional unit can be arranged above or below the covering plate, so then the covering plate ends below or above the functional unit and is therefore arranged so as not to overlap it.

In particular, these two spatial directions of the projection plane mentioned above are the height direction and the width direction of the household refrigerator.

According to one embodiment the covering plate ends in the height direction of the household refrigerator above this functional unit and the functional unit is covered at least from above by a cover separate from the covering plate. The spatial direction is therefore the height direction here. The functional unit can then also be covered here by the cover at the front as well, at least in certain sections.

It can be provided that at the end facing the functional unit the covering plate is fixed to the wall. A specific attachment point is created here thereby, so when the cover is removed, the covering plate separate therefrom continues to remain stably fixed to the wall and does not detach or wobble in relation to it. The section which is then no longer covered by the cover can thereby also remain covered when the cover is removed. Undesirable items or media, which should not pass into the region behind the covering plate, can therefore then be hindered from entering into the region of the covering plate even if the cover is removed for access to the functional unit.

It can be provided that at the back, which faces the wall of the inner container, the covering plate is, particularly, an integrated spacer web and therefore designed in one piece with the covering plate. This spacer web is arranged so as to abut the front of the wall. With its flat base part, the covering plate is thereby arranged at a spacing from the wall of the inner container, so a gap is also formed between the covering plate and this wall in which a further functional unit of the household refrigerator can then be arranged. This further functional unit can be, for example, an air channel of a circulation system, with which, for example, air conveyed with a functional unit can be directed into specific regions and can then be directed from there into the receiving space through the covering plate.

Furthermore, additionally or alternatively, a container for receiving liquid can be arranged in this gap between the covering plate and the wall of the inner container. This liquid can be supplied, for example to a dispensing unit of the household refrigerator. The dispensing unit can be designed, for example, for dispensing liquid or a drink and/or ice cubes which is then supplied to a drink, which can be dispensed by the household refrigerator by way of the dispensing unit.

Additional electronic components can also be arranged in this gap, and these can have, for example. a drive unit or a light source or an electrical connector.

This dimensioning of the gap is also exactly predefined by the spacer web. Furthermore, the spacer web then forms a relative, slightly flat abutment on the front of the wall. Undesirable moisture accumulation, as could occur with a relatively small gap or with large-area abutment of the covering plate on the wall of the inner container, is prevented thereby. Microbial growth behind the covering plate may also be avoided thereby.

In particular, a functional unit can be covered by this covering plate in the direction of the receiving space and therefore cannot be seen and yet can also be protected, moreover. Items, which are introduced into the receiving space, and in particular stored goods, can thereby be prevented from undesirably bumping against this functional unit. This thereby prevents damage to a functional unit of this kind.

It can be provided that the spacer web of this covering plate is non-destructively detachably fixed, in particular screwed, to the wall of the inner container. This is a mechanically secure and permanent connection and can also be implemented quickly in terms of assembly, moreover.

It can be provided that the cover has an, in particular integrated bearing web, which is therefore formed in one piece with the cover and which abuts a front of the wall and which is screwed to the wall of the inner container. Specified and mechanically stabile connection points can also be created thereby. In particular, forces, which occur on mechanical connection, can also be transferred over a large area thereby, so locally undesirable force peaks can be avoided. It is precisely the wall of the inner container, which is made from plastics material, that is not undesirably severely loaded by forces thereby, so it remains free from damage.

It can be provided that a gap between the covering plate and the cover is covered by a separate panel. The panel is therefore a third individual component of the cover system. The panel serves, in particular, as a screen for those transition regions that result between the cover and the covering plate. Since it is preferably precisely at this transition that the attachment points firstly of the covering plate with the wall of the inner container and secondly of the cover with the wall of the inner container are also formed, these connection points, in particular screw holes, may be covered by this panel. A well-ordered visual appearance in the direction of the receiving space is also achieved thereby and undesirable damage to the connection elements is also prevented thereby. Furthermore, the connection elements and the connection points are also arranged so as to be protected, for example form dirt, by this panel. The panel can essentially extend over the complete width of the receiving space. The panel can have a strip-like design, in other words have a longitudinal extension, for example in the width direction, which is essentially greater than the two remaining extensions perpendicular thereto.

The covering plate and/or the cover can essentially extend over the complete width of the receiving space. It is possible, in particular, for the covering plate and/or the cover and/or the panel to extend essentially over the same length in the width direction.

It is precisely due to this kind of local arrangement of the different connection points that a relatively small panel may be implemented, yet this plurality of separate connection points may then be locally concentrated such that a plurality of these connection points and the connection elements arranged there are accessible by removal of the panel. Assembly and overall handling for installation and removal of the individual components is also simplified and accelerated thereby.

It is preferably provided that the panel engages behind an end of the covering plate facing the cover. This also creates a mechanical abutment and support system which achieves overlapping interlocking of the panel and covering plate in the height direction. Gaps, which occur between the panel and the covering plate, towards the back are covered thereby, so no undesirable entry of media, such as liquid or dust, can occur in this interface area.

It can be provided that a front of the covering plate facing the receiving space and a front, facing the receiving space, of a section of the panel ending at the covering plate are arranged flush with each other. A continuous transition of this kind means that a smooth overall surface can be achieved at the front, also enabling problem-free insertion of stored goods and/or containers into the remaining volume region of the receiving space since these components are not jammed or braced or scratched here either since there is no protruding edge at this interface area between the panel and covering plate.

It can be provided that the panel covers the spacer web in the direction of the receiving space. The advantages that are associated therewith have already been mentioned above in respect of the function of the panel as a cover for the connection points and connection elements. In particular, it is then not possible for mechanical contact to be made with the spacer web either, and it is then not undesirably deformed, for example in the case of an undesirably forceful insertion or by an item introduced into the receiving space striking it.

It can be provided that the panel is non-destructively detachably arranged, in particular screwed, on the wall of the inner container.

It can be provided that the cover and the panel are screwed at least at one attachment point together with a screw to the panel. It is also possible for the covering plate and panel together with a screw to be screwed to the wall at least at one attachment point. It is therefore provided here that two separate components are simultaneously fixed by a connection point or attachment point and then with a connecting element in this regard at this point to the wall of the inner container. This also enables the number of fastening elements and attachment points to be reduced and a fast assembly concept.

The cover and/or the covering plate and/or the panel can preferably be disassembled without being destroyed.

In accordance with an added feature of the invention, the panel has a threaded plug in which on a plug base of this threaded plug a hole for passing through a screw is formed. In the assembled state the screw is thereby arranged countersunk and does not protrude forwards into the receiving space. Abutment on the screw by, for example, chilled goods and therefore damage to the screw connection can be prevented thereby. Stored goods can similarly be prevented from being scratched or torn open or being damaged in some other way by this screw. The same applies to containers which are introduced into the receiving space, and which are designed for receiving food. Furthermore, this kind of threaded plug means this fastening element in the form of the screw is arranged so as to be hidden to the maximum, so it is not immediately obvious to an observer who is looking into the receiving space. This, in turn, provides a visually well-ordered appearance.

In accordance with another feature of the invention, the plug base abuts the bearing web. Flat contact points are also then created here therefore, and these prevent undesirable tilting of the panel in the direction of the cover.

It can be provided that formed on a top wall of the cover is a stop that is raised in the direction of the covering plate, on which stop the panel is supported in the direction of the wall. Viewed in the height direction of the household refrigerator, the panel therefore overlaps this stop, so, viewed in the depth direction of the household refrigerator, the panel cannot undesirably slip forwards, and therefore an additional structure is created which promotes position fixing of the panel.

In accordance with a preferred feature of the invention, the functional unit is a no-frost unit. The household refrigerator is then designed, in particular, as a no-frost-household refrigerator.

The no-frost unit has an evaporator which is also covered by the cover. In particular, the no-frost unit has a fan. The evaporator is vertically oriented in particular, and this means that in the height direction of the household refrigerator it extends with its planar extent in the back region and extends parallel to a back wall of the inner container.

A no-frost household refrigerator is fitted with no-frost technology which has a no-frost unit. No-frost technology designates a technical method in which the humidity in an interior designed as a freezer compartment is reduced. As a result, the food does not ice up, or icing up is much reduced, and defrosting of the freezer compartment can be dispensed with or only has to be carried out in much reduced time cycles. With no-frost technology of this kind, cooling elements designed, for example, as cooling fins, and therefore a heat exchanger of the secondary circuit, are located in a separate region in the interior. During the cooling phase the cold air is then introduced by a fan from this separate region into the interior and therefore the freezer compartment. These appliances are designed in such a way that air circulates through all compartments of the interior and enters as a circuit into the separate region again. Since cold air holds less moisture, this condenses as frost predominantly only on the heat exchanger of the secondary refrigeration circuit, which is located in the separate region, and is the coldest point in the no-frost household appliance which has contact with air. It can then be provided that in specific intervals a defrost mode is implemented in which this first heat exchanger in the separate region is defrosted. For this purpose, a heater in particular is provided in the no-frost household refrigerator, by which this heat exchanger is heated. The water then resulting from the defrosting layer of ice can run out of the interior, and therefore also out of the appliance, by way of a run-off channel and can be collected in a collecting tray which can also be used as an evaporation container. In particular, the fan is deactivated in defrost mode, so the freezer compartment continues to remain cooled. Icing up of cooling ribs is significantly reduced by no-frost technology and the humidity throughout the entire household refrigerator is reduced, so the formation of layers of ice is also significantly reduced.

The humidity in the freezer compartment is significantly reduced in a no-frost appliance by an exemplary, relatively simple method. This is achieved, in particular, by separation of the cooling fins from the actual cooling region or refrigerator compartment, with the cold air being conveyed with the aid of a fan into the interior of the freezer or the freezer compartment. The cold air circulates as a circuit through all compartments of the refrigerator and enters the cooling part again. Since it can absorb the moisture only poorly, and cannot retain it well, the moisture condenses on the cooling fins. These are heated and defrosted at regular intervals and the water preferably passes, for example via a channel, into an evaporation container. The humidity is reduced throughout the appliance and almost no layers of ice form. In contrast to conventional appliances, most of the resulting moisture, which leads to icing up of the conventional freezers, collects in the separate region of the cooling fins in the household refrigerator with no-frost technology.

The detail terms "top," "bottom," "front," "back," "horizontal," "vertical," "depth direction," "width direction," "height direction," etc. indicate the positions and orientations when the appliance is properly used and properly arranged and in the case in which an observer stands in front of the appliance and looks in the direction towards the appliance.

Further features of the invention emerge from the claims, figures and description of the figures. The features and feature combinations mentioned in the description above, as well as the features and feature combinations mentioned below in the description of figures and/or shown in the figures alone can be used not just in the respectively disclosed combination, but also in other combinations without departing from the scope of the invention. Embodiments of the invention, which are not explicitly shown and described in the figures but emerge from the statements made and can be generated by separate feature combinations, should therefore also be regarded as encompassed and disclosed. Embodiments and feature combinations which therefore do not have all features of an originally worded independent claim should also be regarded as being disclosed. Furthermore, embodiments and feature combinations, in particular as a result of the statements presented above, which go beyond or deviate from the feature combinations presented in the references in the claims, should be regarded as being disclosed.

The construction and method of operation of the invention, together with additional objects and advantages thereof will be best understood from the following description of specific embodiments when read in connection with the accompanying drawings.

BRIEF DESCRIPTION OF THE SEVERAL VIEWS OF THE DRAWING

Identical elements or those with the same function are provided with identical reference numerals in the figures.

DETAILED DESCRIPTION OF THE INVENTION

Figure 1:
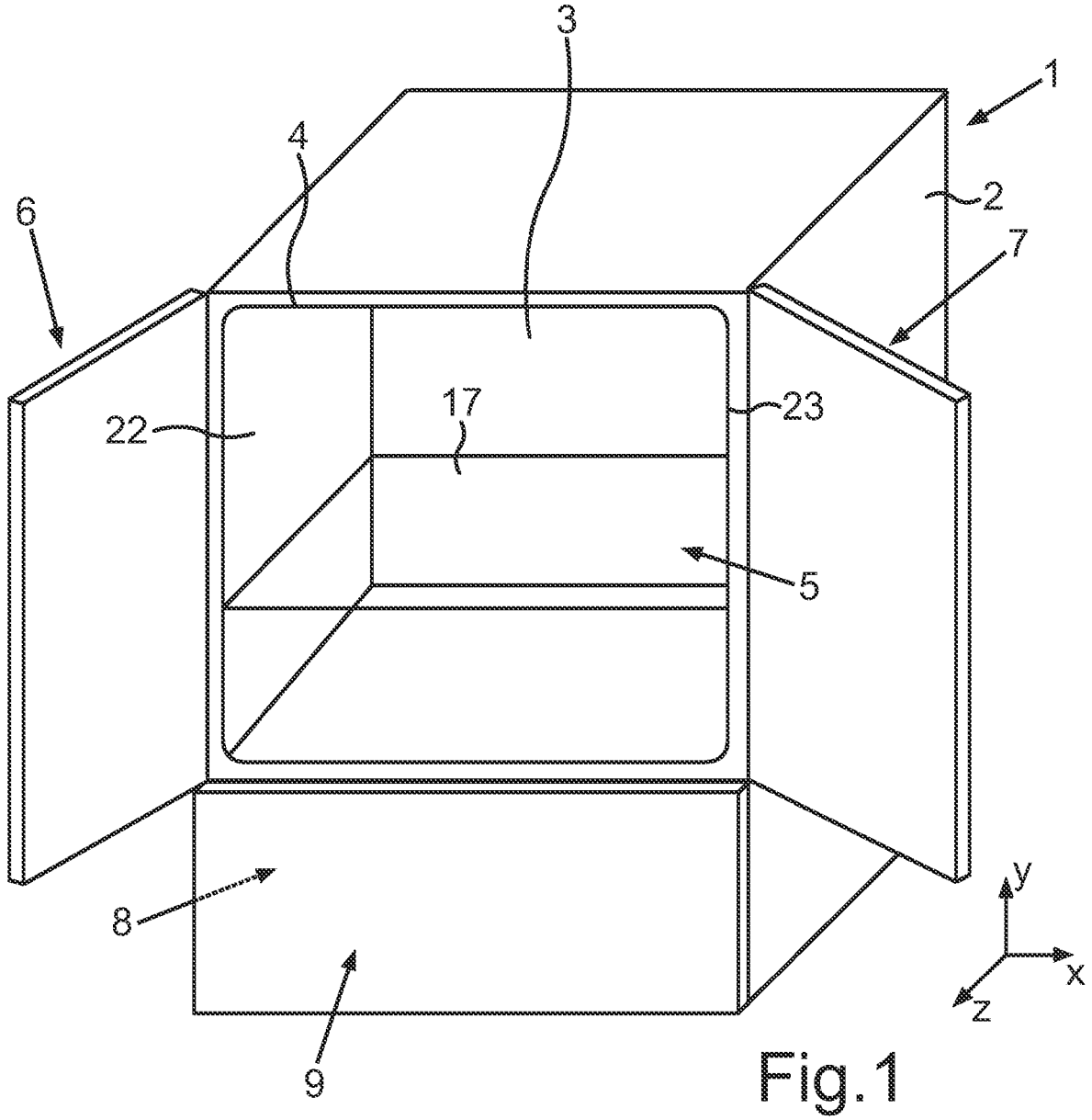
FIG. 1 is a perspective view of an exemplary embodiment of a household refrigerator according to the invention.

Referring now to the figures of the drawing in detail and first, particularly, to FIG. 1 thereof, there is shown FIG. 1 shows in a schematic view a household refrigerator 1 which is designed for storing and conserving food. In the exemplary embodiment illustrated here, the household refrigerator 1 is a fridge-freezer. It has a housing 2 in which a first receiving space 3 is formed, which is a refrigerator compartment in the exemplary embodiment. The first receiving space 3 is delimited by walls of an inner container 4. At the front, the inner container 4, and therefore also the first receiving space 3, has a loading opening 5 which can be sealed by two separate doors 6 and 7. The loading opening 5 is a continuous opening without interruption and the first receiving space 3 is also a continuous space without interruption. The two doors 6 and 7 are pivotally arranged on the housing 2 by way of vertically oriented pivot axes in each case, which are therefore oriented in the height direction (y-direction).

In the exemplary embodiment the household refrigerator 1 has, moreover, a second receiving space 8 that is separate from the first receiving space 3, and which is a freezer compartment. Viewed in particular in the vertical direction, and therefore in the height direction, the second receiving space 8 is arranged below the first receiving space 3. In the height direction the two receiving spaces 3 and 8 are arranged so as not to overlap. The second receiving space 8 can be sealed at the front by a separate third door 9, wherein this door 9 is formed, in particular a front wall of a drawer that can be displaced in the depth direction (z-direction), which can be pushed into and pulled out of the second receiving space 8. The doors 6, 7 and 9 are arranged so as not to overlap each other and are positioned side by side at the front. In particular they are front end parts or visible parts of the household refrigerator 1.

Figure 2:
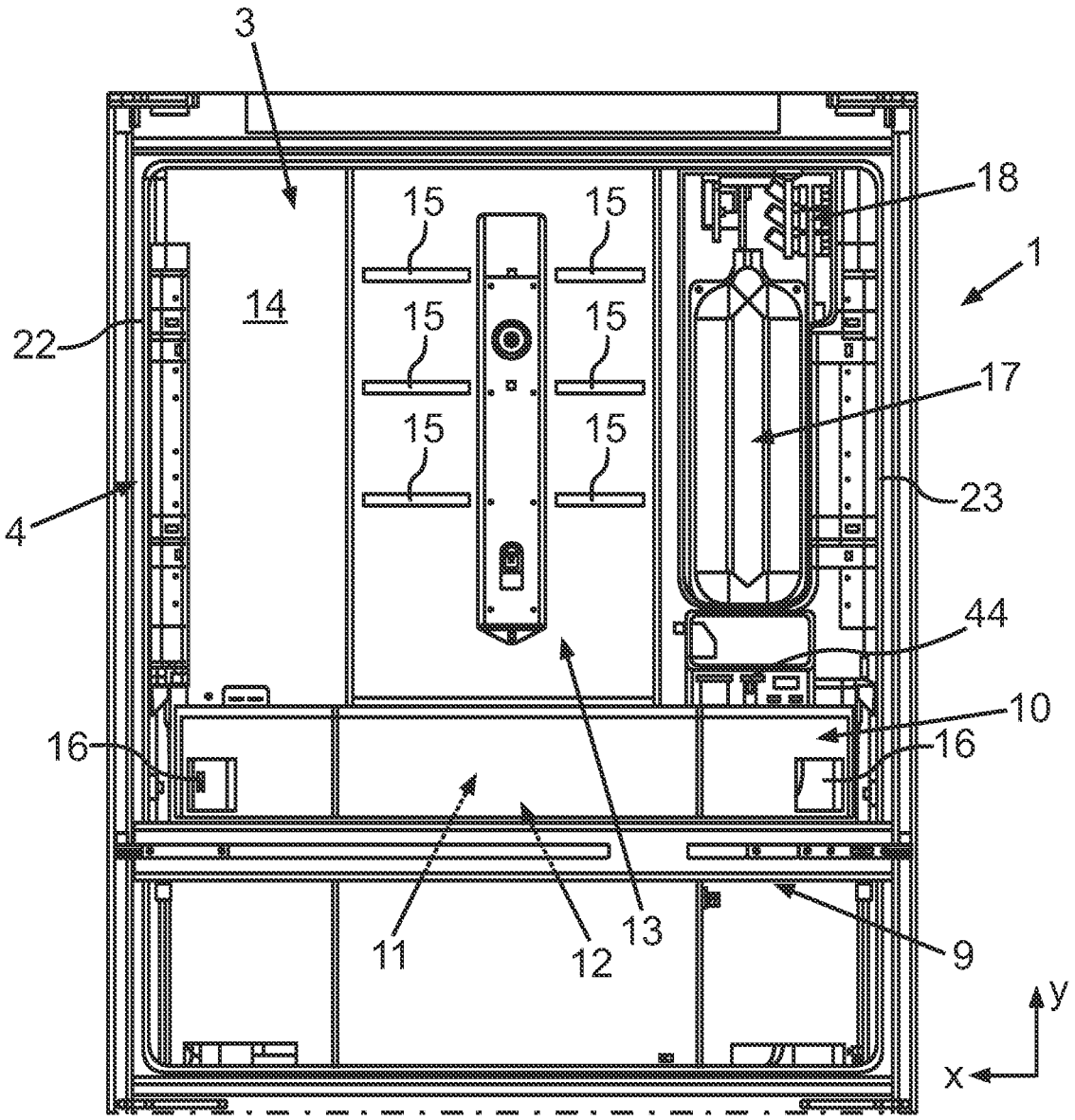
FIG. 2 shows a simplified front view of the household refrigerator of to FIG. 1 with the doors removed.

FIG. 2 shows the household refrigerator 1, which is a no-frost household refrigerator, in a front view and without the doors 6, 7 and 9. The household refrigerator 1 comprises a no-frost unit 10 which is installed upright and is therefore oriented in the vertical direction. The no-frost unit 10 has an evaporator 11, which cannot be seen in FIG. 2, arranged behind a wall. The no-frost unit 10 comprises, moreover, a fan 12 (FIG. 3), with which cold air generated in the region of the evaporator 11 is circulated in the household refrigerator and which is similarly arranged behind the wall. The wall can be a housing wall of the no-frost unit 10.

The no-frost unit 10 is formed at least in a lower back region of the first receiving space 3. The no-frost unit 10 also extends, in particular, into the second receiving space 8 and is also arranged in the back region there.

The household refrigerator 1 comprises, moreover, an air channel 13 (FIG. 2), which is formed in the receiving space 3 in front of a back wall 14 of the inner container 4. The back wall 14 delimits the first receiving space 3 in the depth direction at the back and is an integral part of the inner container 4. The air channel 13 is coupled to the no-frost unit 10 for air circulation and in the exemplary embodiment has a plurality of outlet openings 15 which are arranged in pairs at the same level, but are then formed, moreover, at different levels in the height direction (y-direction).

In the exemplary embodiment the no-frost unit 10, which is a functional unit of the household refrigerator 1, has two separate suction openings 16 through which air from the receiving space 3 is aspirated into the no-frost unit 10. In the exemplary embodiment a functional unit in the form of a water tank 17 is arranged, moreover, in the region of the back wall 14 next to the air channel 13, which is a functional unit. Liquid for a non-illustrated dispensing unit of the household refrigerator 1 is arranged in this water tank 17. The dispensing unit is configured for dispensing liquid and/or ice cubes and preferably has on a door, for example the door 6, and a dispenser unit for dispensing a drink.

Furthermore, valves 18 can be arranged in the back region of the receiving space 3 as further functional units. Similarly, an electrical connector can be arranged as a further functional unit.

Figure 3:
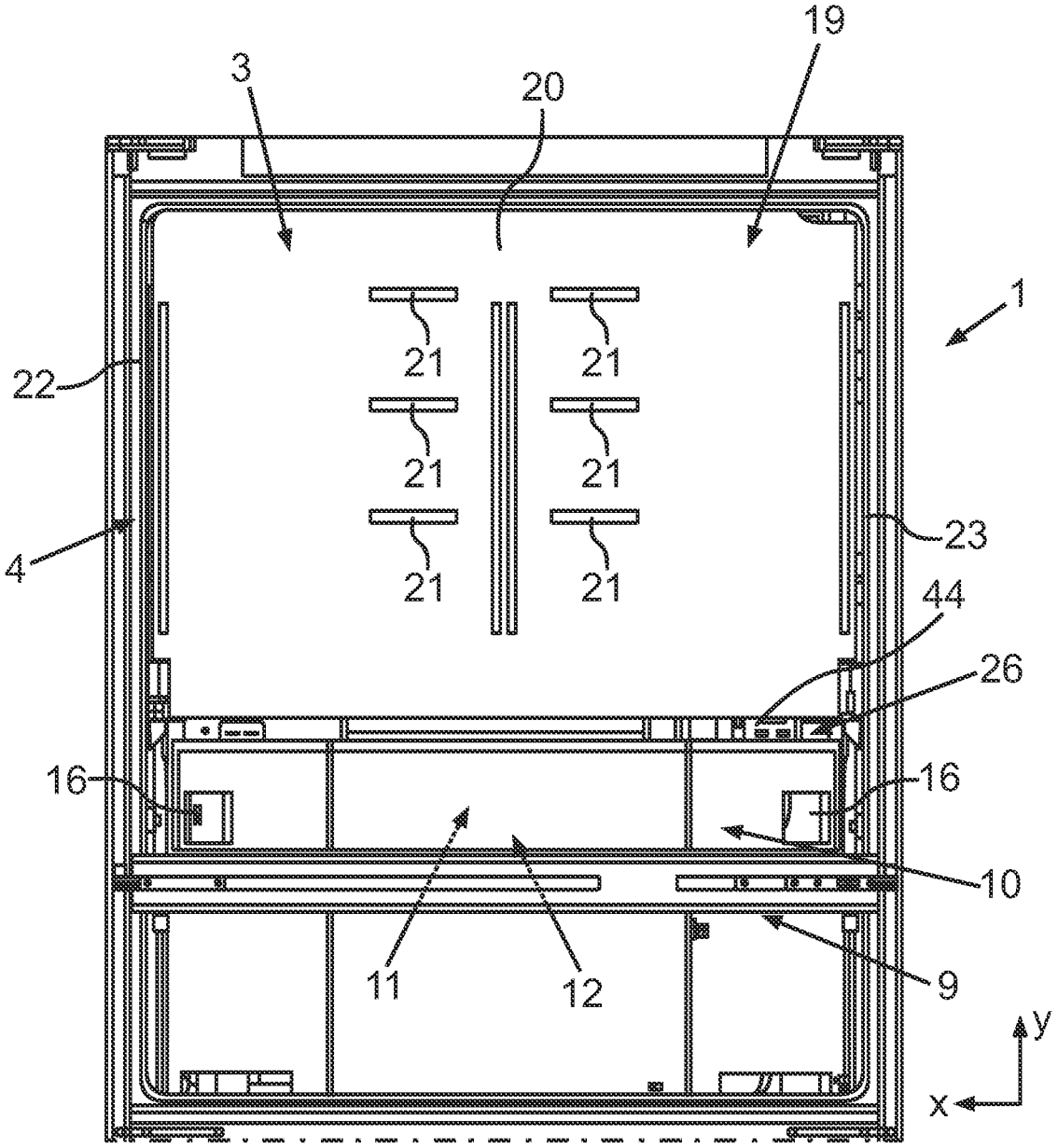
FIG. 3 is a view of the household refrigerator of FIG. 2 with an additionally assembled covering plate.

FIG. 3 shows the household refrigerator 1 according to the view in FIG. 2. However, a covering plate 19 is also installed here which is arranged on the receiving space 3 and is a plate-like unit separate from the walls of the inner container 4, in particular also from the back wall 14. As can be seen, the covering plate 19 covers functional units, in particular in the exemplary embodiment the air channel 13, the water tank 17 and the valves 18 as well an optionally present electrical connector in the direction of the receiving space 3. This covering plate 19 is arranged in the depth direction, and therefore in the z-direction, with its base plate 20 offset forwards and at a spacing from the back wall 14. A gap is thereby formed between the back wall 14 and this base plate 20, in which gap said functional units are arranged. As can be seen, this base plate 20 has, in particular, slot-shaped openings 21 which are arranged in the region of the outlet openings 15 of the air ducts 13, so the conveyed air, which is blown out of the air channel 13 through the outlet openings 15 in the direction of the receiving space 3, also passes through these openings 21 and therefore into the receiving space 3.

As can be seen, this covering plate 19 extends in the width direction over the entire width between vertical side walls 22 and 23 of the inner container 4, so the back wall 14 is completely covered in this regard. In the height direction, however, the covering plate 19 ends at a spacing from the no-frost unit 10 and above this no-frost unit 10.

Figure 4:
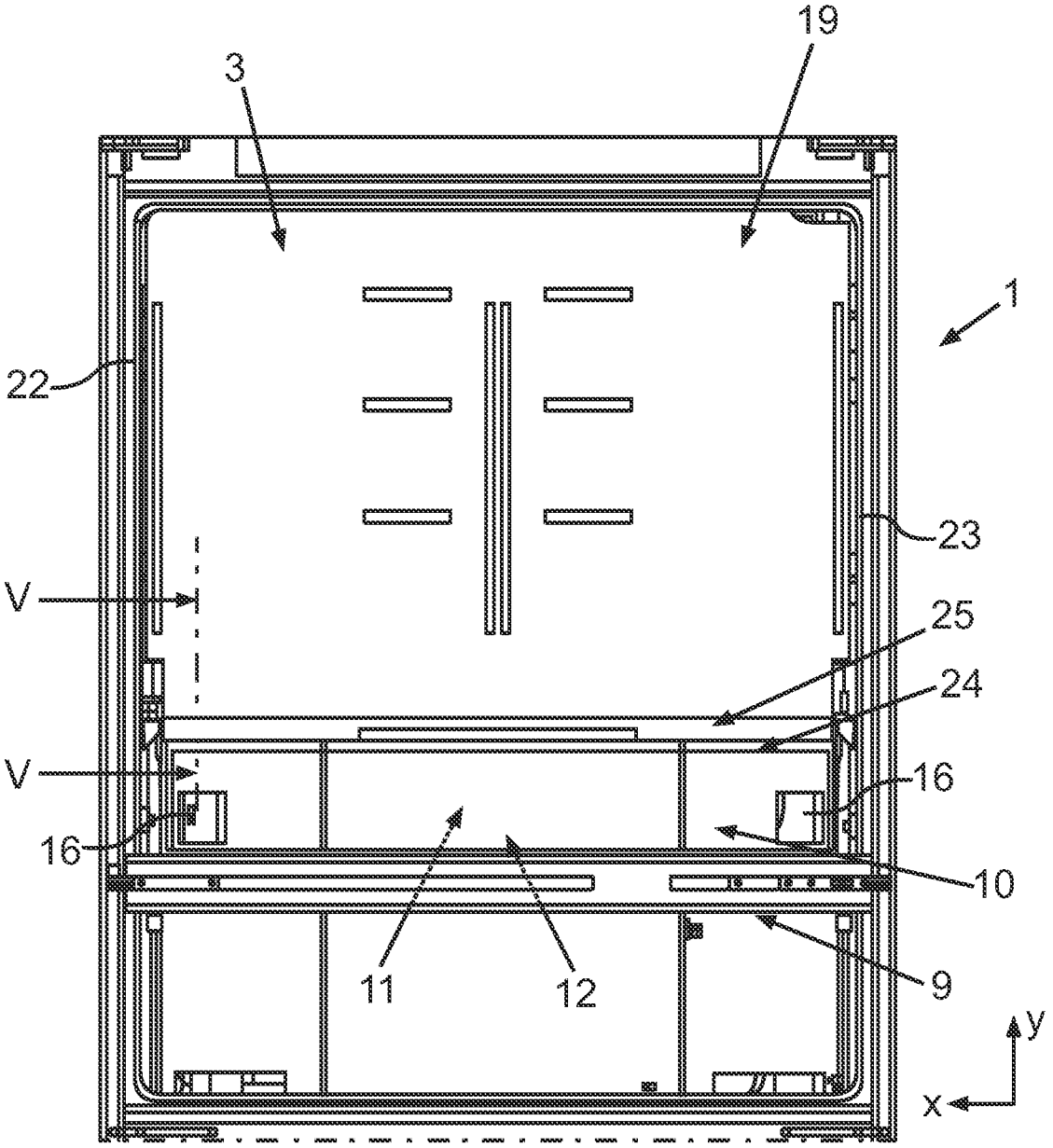
FIG. 4 is a view of the household refrigerator of FIG. 3 with an additionally assembled cover of a functional unit and an additionally mounted panel.

FIG. 4 shows the household refrigerator 1 according to the view in FIG. 3, with a cover 24 being arranged here in addition to the covering plate 19, and this is designed separately from the covering plate 19 and is part of the cover system. This cover 24 covers the no-frost unit 10 at least from above, in particular also at the front at least in certain sections. Viewed in the height direction this cover 24 is formed beneath the covering plate 19 and in this connection is also positioned at a spacing from and at a certain distance from this covering plate 19.

Furthermore, FIG. 4 shows a separate panel 25. This panel 25 is likewise part of the cover system and arranged between the covering plate 19 and the cover 24. A gap 26 (FIG. 3), as is formed between the lower end of the covering plate 19 and the no-frost unit 10, is covered at the front by this panel 25. Furthermore, the cover 24 is also covered at least in certain sections at the front by this panel 25.

Figure 5:
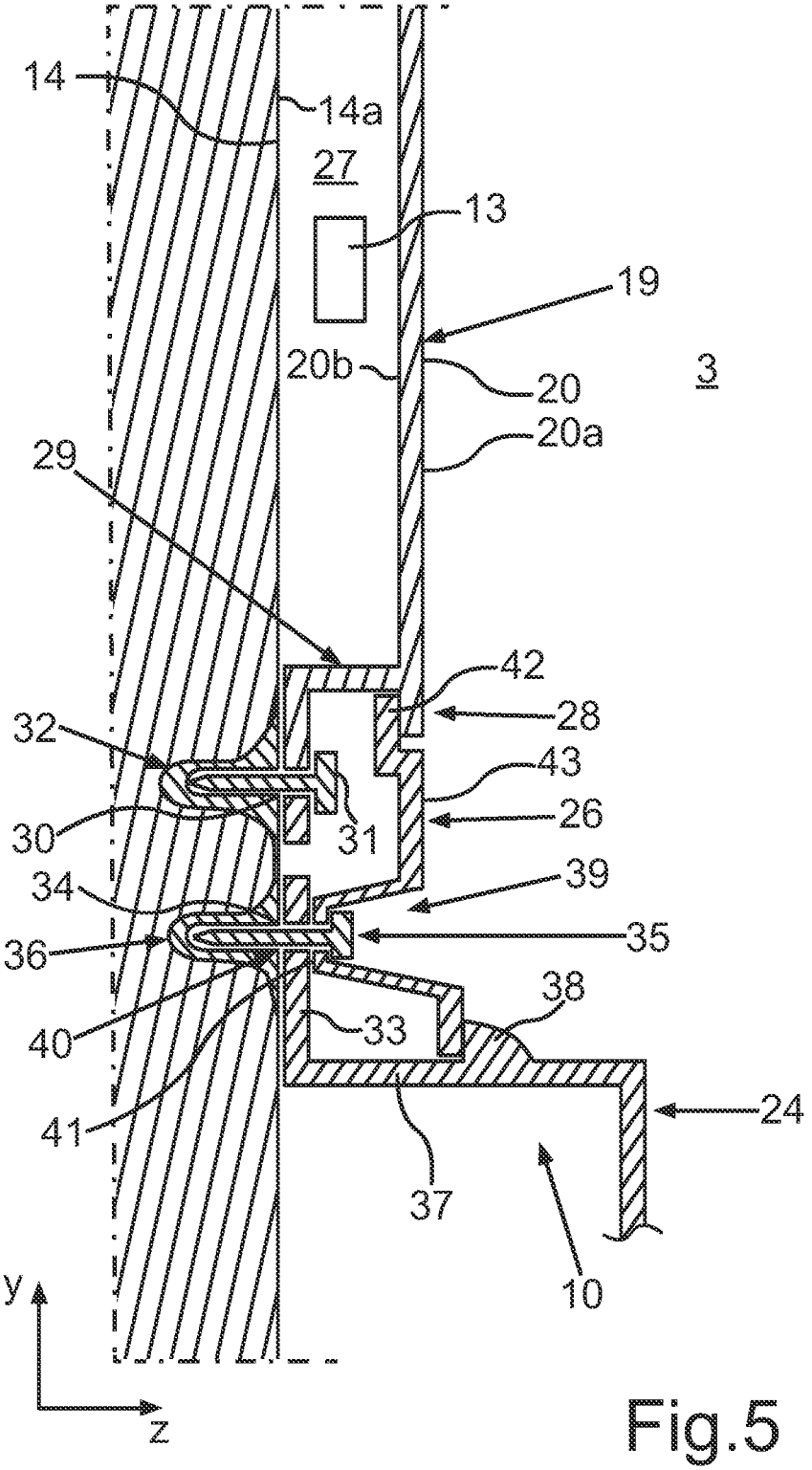
FIG. 5 is a vertical sectional view of a section of the household refrigerator according to FIG. 4 in the region of the covering plate, panel and cover, taken along the line V-V and viewed in the direction of the arrows.

FIG. 5 shows in a vertical section (y-z plane) the household refrigerator 1 according to the view in FIG. 4 along the cut line V-V.

As can be seen, the base plate 20 is arranged at a spacing from the back wall 24, so a functional unit, represented by way of example and symbolically here by the retainer of the air ducts 13, is arranged in said space 27.

The covering plate 19 is fixed, in particular screwed, to the back wall 14 at an end 28 facing the no-frost unit 10. In the exemplary embodiment a spacer web 29 is formed in one piece on the base plate 20 here, and this is L-shaped in this vertical section. With a leg of this L-shape this spacer web 29 abuts a front 14*a* of the back wall 14 in a planar manner. A screw hole 30 is also formed on this leg, through which hole a screw 31 can be passed and be screwed in a backing part 32 to the back wall 14.

Furthermore, it can be seen that the cover 24 also has a bearing web 33 which abuts the front 14*a* of the back wall 14 in a planar manner. This bearing web 33 has a screw hole 34 through which a screw 35 is guided in order to be screwed with a further backing part 36 to the back wall 14.

Formed in one piece on the top wall 37 of the cover 24, with which the no-frost unit 10 is covered from above, is a web or a stop 38 on the top facing the covering plate 19, which web or stop the panel 26 abuts. The panel 26, which is formed, in particular, in one piece from metal, has a threaded plug 39 in which the screw 35 is arranged countersunk. In the exemplary embodiment it is provided that the panel 26 and cover 24 are fixed together at one attachment point 40 at least to the back wall 14. For this purpose, it is provided that the screw 35 is guided through the panel 26 as well as through the lead-through 34 of the bearing web 33 and therefore a shared screw connection point here. The threaded plug 39 sits with a plug base 41 on the bearing web 33. Furthermore, it can be seen that the panel 26 engages behind the covering plate 19 and in this connection has a bearing web 42 which, viewed in the height direction, is arranged so as to overlap the base plate 20. The spacer web 29 is set back at the top in this regard in relation to the lower edge of the base plate 20, enabling this engagement behind.

In particular, it is provided that a front 43 of the section of the panel 26, which directly adjoins the lower edge of the base plate 20, is arranged flush with a front 20*a* of this base plate 20 facing the receiving space 3.

As can be seen, the panel 26 covers the connection points that are arranged adjacent to each other, firstly the connection point of the covering plate 19 with the back wall 14, and secondly the connection point of the cover 24 with the back wall 14 in the direction of the receiving space 3.

The covering plate 19 is preferably formed in one piece from plastics material. This plastics material plate can be, for example, structured on the front 20*a* and/or be individually designed in terms of color, however. For example, it can also have a film or a coating which imparts a metallic visual impression.

In particular, it is provided that a backing part for an electrical connector is also arranged in the region of the panel 26, into which part at least one electrical connector of the no-frost unit 10 can be pushed. This connector backing part 44 is shown in FIG. 2 and FIG. 3. For example, if a light source is arranged in the covering plate 19, the light source can be inserted at this connector. Further components, which have to be appropriately electrically coupled for electrical power supply, can be plugged in at this connector 44. For example, this can also be an individual sensor, for example a temperature sensor.

In particular, the panel 26 is pushed behind the base plate 20 with the web 42 and then with the no-frost unit 10 is screwed onto the back wall 14.

The two backing parts 32 and 36 are arranged at the foam side, which means that they are arranged with a gap between the inner container 4, and therefore the back wall 14, and an outer housing of the housing 2 and are surrounded by this insulating foam.

In addition to the highly flexible and variable accessibility of individual local regions behind the cover system, assembly and disassembly of the individual components is also enabled particularly easily and safely. In addition to being screwed to the back wall 14, the covering plate 19 can also be latched or suspended to/on at least one other connection point.

The following is a summary list of reference numerals and the corresponding structure used in the above description of the invention:

1 household refrigerator
2 housing
3 first receiving space
4 inner container
6 door
7 door
8 second receiving space
9 door
10 no-frost unit
11 evaporator
12 fan
13 air channel
14 back wall
14*a* front
15 outlet openings
16 suction openings
17 water tank
18 valves
19 covering plate
20 base plate
20*a* front

20*b* back
21 openings
22 side wall
23 side wall
24 cover
25 panel
26 gap
27 space
28 end
29 spacer web
30 screw hole
31 screw
32 backing part
33 bearing web
34 screw hole
35 screw
36 backing part
37 top wall
38 stop
39 threaded plug
40 attachment point
41 plug base
42 bearing web
43 front
44 connector backing part

The invention claimed is:

1. A household refrigerator, comprising:

an inner container formed with walls delimiting a receiving space for food;

a functional unit of the household refrigerator disposed in said receiving space in front of a given wall of said inner container, said functional unit being a no-frost unit including an evaporator;

a substantially flat covering plate separate from said inner container and disposed in said receiving space in front of, and at a spacing distance from, the given wall, said covering plate having a footprint extending across an entire width of the given wall and ending next to said functional unit and said covering plate being fixed to the given wall at an end facing said functional unit, said functional unit being disposed outside of said footprint; and a cover separate from said covering plate and disposed to cover said functional unit, said cover covering said functional unit at least in certain sections thereof in the one spatial direction.

2. The household refrigerator according to claim 1, which comprises a spacer web formed on a back side of said covering plate, said spacer web abutting a front of the given wall.

3. The household refrigerator according to claim 2, wherein said spacer web is screwed to the given wall.

4. The household refrigerator according to claim 1, wherein said cover has a bearing web that abuts a front of the given wall and that is screwed to the given wall.

5. The household refrigerator according to claim 1, which comprises a separate panel covering a gap between said covering plate and said cover.

6. The household refrigerator according to claim 5, wherein said panel engages behind an end of said covering plate facing said cover.

7. The household refrigerator according to claim 5, wherein a front of said covering plate facing said receiving space and a front, facing said receiving space, of a section of said panel ending at said covering plate are arranged flush with one another.

8. The household refrigerator according to claim 5, which comprises a spacer web formed on a back side of said covering plate, said spacer web abutting a front of the given wall, and wherein said panel covers the spacer web in a direction of said receiving space.

9. The household refrigerator according to claim 2, which comprises a separate panel covering the spacer web in a direction of said receiving space.

10. The household refrigerator according to claim 5, wherein said panel is screwed to the given wall.

11. The household refrigerator according to claim 10, wherein said cover and said panel together are screwed at an attachment point to the given wall by a screw.

12. The household refrigerator according to claim 10, wherein said panel has a threaded plug in which a hole is formed on a plug base for passing through a screw.

13. The household refrigerator according to claim 12, wherein said plug base abuts said bearing web.

14. The household refrigerator according to 13, wherein a stop is formed on a top wall of said cover, said stop is raised in a direction of said covering plate, and said panel is supported on said stop in a direction of said given wall.

15. The household refrigerator according to claim 1, wherein said covering plate ends above said functional unit in a height direction of the household refrigerator and the functional unit is covered at least in certain sections from above by said cover that is separate from said covering plate.

* * * * *